US006375915B1

(12) United States Patent
Bärhold et al.

(10) Patent No.: US 6,375,915 B1
(45) Date of Patent: Apr. 23, 2002

(54) METHOD OF REGENERATING A SPENT PICKLING SOLUTION

(75) Inventors: Frank Bärhold, Quirnbach; Werner Engelhardt, Bendorf, both of (DE)

(73) Assignee: Keramchemie GmbH, Siershahn (DE)

( * ) Notice: Subject to any disclaimer, the term of this patent is extended or adjusted under 35 U.S.C. 154(b) by 0 days.

(21) Appl. No.: 08/968,136

(22) Filed: Nov. 12, 1997

(30) Foreign Application Priority Data

Nov. 15, 1996 (DE) ..... 196 47 196
Oct. 29, 1997 (DE) ..... 197 47 693

(51) Int. Cl.[7] ..... C23G 1/36
(52) U.S. Cl. ..... 423/394.2; 423/484; 423/488; 423/DIG. 1
(58) Field of Search ..... 423/484, 488, 423/394.2, DIG. 1; 216/93

(56) References Cited

U.S. PATENT DOCUMENTS

| | | | | | |
|---|---|---|---|---|---|
| 3,399,964 A | * | 9/1968 | Michels et al. | ..... | 423/488 |
| 3,529,931 A | * | 9/1970 | Moklebust | ..... | 423/DIG. 1 |
| 3,578,401 A | * | 5/1971 | Ueberle et al. | ..... | 423/DIG. 1 |
| 3,658,483 A | * | 4/1972 | Lienau et al. | ..... | 423/DIG. 1 |
| 5,149,515 A | * | 9/1992 | Karner et al. | ..... | 423/484 |
| 5,244,551 A | * | 9/1993 | Brücken et al. | ..... | 423/488 |

FOREIGN PATENT DOCUMENTS

| | | | | | |
|---|---|---|---|---|---|
| DE | 4020560 | | 6/1990 | | |
| DE | 4315551 | | 5/1993 | | |
| DE | 4402028 | | 1/1994 | | |
| JP | 6-57466 | * | 3/1994 | ..... | 423/488 |
| WO | 93/10038 | * | 5/1993 | ..... | 423/488 |

OTHER PUBLICATIONS

Translation of DE 4315551, May 1993.*

"Galvanotechnik" D–88348 Saulgau, Germany, 87 (1996) No. 6, pp. 1979–1986 (no month).

* cited by examiner

*Primary Examiner*—Ngoc-Yen Nguyen
(74) *Attorney, Agent, or Firm*—Friedrich Kueffner

(57) ABSTRACT

In a method of regenerating a spent pickling solution composed of nitric acid and hydrofluoric acid and containing metal fluorides and metal nitrates, the pickling solution is heated in a reactor to about 300–1,000° C., the metal fluorides and the metal nitrates are pyrohydrolized, and the metal oxides formed as a result are removed as a granulate, and the gas produced in the fluodized bed reactor is dedusted, cooled and fed to an acid recovery unit. The spent pickling solution is initially separated in a separating process into a partial flow with free acid and into a partial flow enriched with metal salts, and the partial flow enriched with free acid is fed to the acid recovery unit and the partial flow enriched with metal salts is fed to the fluidized bed reactor.

8 Claims, 1 Drawing Sheet

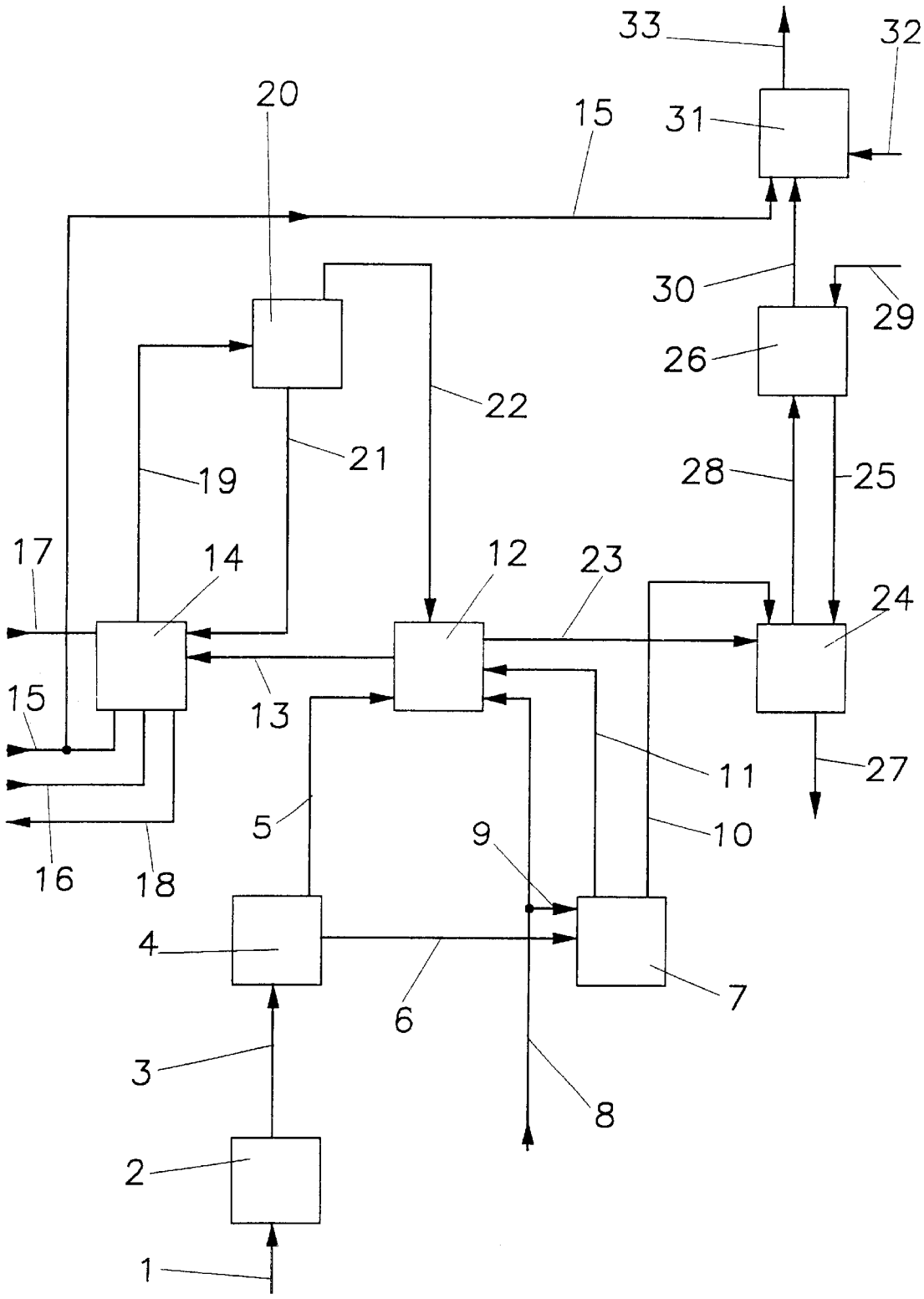
33
32
20
15
31
30
29
26
22
21
19
28
25
17
14
12
23
24
15
13
11
27
5
9
10
16
18
4
7
6
3
8
2
1

METHOD OF REGENERATING A SPENT PICKLING SOLUTION

BACKGROUND OF THE INVENTION

1. Field of the Invention

The present invention relates to a method of regenerating a spent pickling solution composed of nitric acid and hydrofluoric acid and containing metal fluorides and metal nitrates. In accordance with the method, the pickling solution is heated in a reactor to about 300–1,000° C., the metal fluorides and the metal nitrates are pyrohydrolized, and the metal oxides formed as a result are removed as a granulate, and the gas produced in the fluodized bed reactor is dedusted, cooled and fed to an acid recovery unit.

2. Description of the Related Art

DE-OS 43 15 551 discloses a method of regenerating a spent pickling solution composed of nitric acid and hydrofluoric acid and containing metal fluorides and metal nitrates, in which, after carrying out upgrading, for example, in a cycle, the spent pickling solution is introduced into a fluidized bed reactor which has been heated to a temperature of about 500–1,000° C. and in which a fluidized bed is formed, for example, of iron oxide granulate. In the reactor, the metal fluorides contained in the spent pickling solution are pyrohydrolized. Subsequently, the acid contained in the flue gas leaving the fluidized bed reactor is recovered by absorption of hydrogen fluoride and nitrogen oxides. During the pyrohydrolysis, the nitrate is reduced to nitrogen oxide, which means that the recovery of the nitric acid portion is relatively cumbersome. In addition, relatively expensive oxidizing agents are required. Moreover, the degree of recovery still needs improvement.

SUMMARY OF THE INVENTION

Therefore, it is the primary object of the present invention to further develop the above-described method in such a way that the efficiency of the nitrate content and fluoride content in the form of free acid in the spent pickling solution or in the mixed acid is improved, and the recovery of the nitric acid can be carried out without the use of oxidizing agents and, thus, with lower operation costs. In addition, the method should continue to have the advantage that the dissolved metal irons can be transferred into a dust-free and recoverable form which can be treated well and is environmentally without problems.

In accordance with the present invention, in a method of the above-described type, the spent pickling solution is initially separated in a separating process into a partial flow with free acid and into a partial flow enriched with metal salts, and the partial flow enriched with free acid is fed to the acid recovery unit and the partial flow enriched with metal salts is fed to the fluidized bed reactor.

The method according to the present invention makes it possible to recover approximately 99% of the fluoride portion and approximately 90% of the nitrate portion in the form of a directly reusable mixed acid. Oxidizing agents are no longer required. Waste water flows are no longer produced, so that no neutralizing chemicals are used and no metal hydroxide sludges must be disposed of. The quantity of fresh acid required for topping up the pickling solution can be substantially reduced. Approximately 95% of the metals contained in the spent pickling solution are transferred into a dust-free and recoverable state which can be treated easily and is environmentally without problems.

The various features of novelty which characterize the invention are pointed out with particularity in the claims annexed to and forming a part of the disclosure. For a better understanding of the invention, its operating advantages, specific objects attained by its use, reference should be had to the drawing and descriptive matter in which there are illustrated and described preferred embodiments of the invention.

BRIEF DESCRIPTION OF THE DRAWING

In the drawing:

The single FIGURE of the drawing is a flow diagram of an apparatus for carrying out the method according to the present invention.

DESCRIPTION OF THE PREFERRED EMBODIMENTS

The apparatus illustrated in the drawing serves for regenerating a spent pickling solution composed of nitric acid and hydrofluoric acid, also called mixed acid, and containing metal fluorides and metal nitrates, wherein, at a density of about 1.180 kg/dm$^3$, the pickling solution has the following composition:

| | |
|---|---|
| Iron (Fe) | 33.8 g/l |
| Chromium (Cr) | 7.65 g/l |
| Nickel (Ni) | 5.3 g/l |
| Total free acid | 4.1 mole/l |
| Remainder water | |

The spent pickling solution is conveyed, for example, through a line 1 first into a collecting container 2 and then reaches a microfilter 4 through a line 3 by means of a pump, not shown. In the microfilter 4, the solids contained in the pickling solution are separated in the form of sludge which is then fed through a line 5 to a washing stage, for example, a Venturi washer 12. The filtrate is conducted from the microfilter 4 through a line 6 to a separating stage, which, in the illustrated embodiment, is constructed as a diffusion dialysis unit 7. The separating stage may also be formed by a crystallization or retardation plant. A retardation plant is also called an acid purification unit. Simultaneously, rinsing water is removed from the pickling plant through a line 8 with a branch 9 and is also supplied to the diffusion dialysis unit 7. The filtrate from the microfilter 4 and the rinsing water flow through the diffusion dialysis unit 7 in a countercurrent flow. Because of the different concentrations, the free acids of the filtrate reach the rinsing water from the filtrate. After flowing through the diffusion dialysis unit 7, the rinsing water has become the diffusion product, i.e., the partial flow enriched with free acid, while the filtrate flowing in from the microfilter 4 has now become the dialysis product, i.e., the partial flow enriched with metal salts.

The diffusion product flows from the diffusion dialysis unit 7 through a line 10. The dialysis product leaves the diffusion dialysis unit 7 through a line 11 and is fed together with the rinsing water from the line 8 to a venturi washer 12 which has a so-called Venturi cycle. In this cycle, the dialysis product is conducted with the rinsing water as Venturi liquid and is used for cooling purposes or is heated, as will be described below. A portion of the hydrofluoric acid and the nitric acid as well as the water contained in the Venturi liquid are evaporated. A partial flow of this evaporated solution is removed with the Venturi cycle and is supplied through a line 13 to a fluidized bed reactor 14.

The fluidized bed reactor 14 is heated by a gas which is supplied though a line 15. Air reaches through a line 16 into the fluidized bed reactor 14 where the air burns stoichiometrically with the gas. In the reactor, the desired temperature is approximately between 810° C. and 870° C. Introduced into the fluidized bed reactor 14 through a line 17 is an iron oxide granulate containing 99% $Fe_2O_3$ having the following properties:

| | |
|---|---|
| Density | 5,080 kg/m$^3$ |
| Bulk weight | 3,050 kg/m$^3$ |
| Grain Size | 0.26 mm. |

In the fluidized bed reactor 14, the iron granulate forms a fluidized layer or fluidized bed. In the fluidized bed reactor 14, water and the free hydrofluoric acid evaporate from the partial flow supplied to the Venturi cycle. The nitric acid and the metal fluorides as well as the metal nitrates react in accordance with the following equations:

$$2FeF_3 + 3H_2O \quad Fe_2O_3 + 6\ HF$$

$$2CrF_3 + 3H_2O \quad Cr_2O_3 + 6\ HF$$

$$NiF_2 + H_2O \quad NiO + 2\ HF$$

The reactions produce a granulate-like metal oxide which is removed from the fluidized bed reactor 14 through a line 18. This granulate-like metal oxide has a grain size of about 0.2 mm to 2.0 mm and replaces the iron oxide supplied when the operation of the fluidized bed reactor 14 is started. The grain size mentioned above can be achieved by a continuous removal of the metal oxide.

The hot flue gas, which still contains dust-like metal oxides, leaves the fluidized bed reactor 14 at the top through a line 19 and is conducted through the line 19 to a dust separator 20 constructed as a cyclone. The dust separated in the separator 20 is again returned into the fluidized bed reactor 14 through a line 21, while the flue gas which is essentially free of dust is conducted through a line 22 into the Venturi washer 12. In the washer 12, the flue gas is cooled to a temperature of about 60° C. to 100° C. Simultaneously, the fine dust still contained in the flue gas is separated. Accordingly, the Venturi washer 12 has the purpose of cooling the flue gas, of separating the very fine dust, to upgrade the spent pickling solution and to recover heat.

The flue gas which has been freed of dust and, very importantly, has been cooled, is conducted from the Venturi washer 12 through a line 23 to an absorption unit 24. In an adiabatic counter-current flow absorption in which the diffusion product removed from the diffusion dialysis unit 7 through the line 10 and the absorption product supplied from a gas washer through a line 25 are used as absorption agents, the hydrogen fluoride and the nitric acid are washed out of the flue gas and are dissolved in the liquid phase. In this process, the mixed acid is recovered and removed through a line 27.

The prepurified gas or flue gas is removed from the absorption unit 24, for example, by a fan through a line 28 and is conveyed to the already mentioned gas washer 26. In the gas washer 26, any residues of the hydrofluoric acid which may still be present are washed out. In the gas washer 26, water is used as the absorption liquid, wherein the water is supplied to the gas washer 26 through a line 29. The absorption product then discharged from the gas washer 26 is supplied, as already mentioned, to the absorption unit 24 as absorption agent.

The gas purified of hydrofluoric acid flows through a line 30 to a unit 34 for the removal of nitrogen oxides. In the unit 31, the gas is heated by burning a heating gas supplied though the line 15. By adding ammonia as a reduction agent through the line 32, any nitrous components still contained in the gas are reduced to nitrogen. Subsequently, the purified gas can be discharged to the outside through a chimney 33.

While specific embodiments of the invention have been shown and described in detail to illustrate the inventive principles, it will be understood that the invention may be embodied otherwise without departing from such principles.

We claim:

1. In a method of regenerating a spent pickling solution composed of nitric acid and hydrofluoric acid and containing metal fluorides and metal nitrates, the method including heating the pickling solution in a fluidized bed reactor to a temperature of about 300–1,000° C., pyrohydrolyzing the metal fluorides and metal nitrates so as to produce a gas and metal oxides in the form of a granulate, removing the granulate from the fluidized bed reactor and dedusting and cooling the gas produced in the fluidized bed reactor and feeding the cooled gas to an acid recovery unit, the improvement comprising separating the spent pickling solution in a separating process into a partial flow enriched with free acid and a partial flow enriched with metal salts, and feeding the partial flow enriched with free acid to the acid recovery unit and feeding the partial flow enriched with metal salts to the fluidized bed reactor.

2. The method according to claim 1, wherein the separation is carried out by one of a diffusion analysis, crystallization and retardation.

3. The method according to claim 1, comprising, prior to separating the solution, filtering out metal-containing sludge contained in the spent pickling solution.

4. The method according to claim 3, comprising feeding the filtered sludge to a Venturi cycle arranged upstream of the fluidized bed reactor.

5. The method according to claim 1, comprising using the partial flow enriched with free acid as absorption liquid in an absorber arranged downstream of the fluidized bed reactor.

6. The method according to claim 1, comprising, after cooling the gas discharged from the fluidized bed reactor, recovering a fluoride portion present in the gas discharged from the fluidized bed reactor in the form of free acid by carrying out a two-stage absorption.

7. The method according to claim 1, comprising utilizing rinsing water from a pickling plant for separating the spent pickling solution.

8. The method according to claim 4, comprising utilizing rinsing water from a pickling plant for the Venturi cycle.

* * * * *